US005078440A

United States Patent [19]

Taniguchi

[11] Patent Number: 5,078,440

[45] Date of Patent: Jan. 7, 1992

[54] APPARATUS FOR EMERGENCY CONVEYANCE OF A HUMAN BEING DISPOSED ON A MOVABLE BODY

[76] Inventor: Kiyoshi Taniguchi, No. 11-12, 3-chome, Nakazato, Kita-ku, Tokyo, Japan

[21] Appl. No.: 458,291

[22] Filed: Dec. 28, 1989

[51] Int. Cl.[5] ..... B66C 1/44

[52] U.S. Cl. ..... 294/116; 294/117; 294/118; 294/902

[58] Field of Search ..... 294/8.6, 16, 28, 82.32, 294/81.61, 115–118, 132, 135, 902; 5/81 R, 83, 84

[56] References Cited

U.S. PATENT DOCUMENTS

| | | | |
|---|---|---|---|
| 306,067 | 10/1884 | Durning | 294/116 X |
| 413,071 | 10/1889 | Lowe | 294/116 X |
| 433,756 | 8/1890 | Wilson | 294/118 |
| 504,600 | 9/1893 | Manning et al. | 294/116 |
| 674,944 | 5/1901 | Stinchcomb et al. | 294/116 |
| 943,220 | 12/1909 | Dufour | 294/116 X |
| 1,381,813 | 6/1921 | Engevik | 294/16 |
| 2,295,768 | 9/1942 | Williamson | 294/116 |
| 2,668,733 | 2/1954 | Boticki | 294/116 X |
| 4,098,533 | 7/1978 | Hanlon | 294/116 |
| 4,421,353 | 12/1983 | Smith | 294/116 X |
| 4,678,217 | 7/1987 | Viola et al. | 294/118 X |

FOREIGN PATENT DOCUMENTS

| | | | |
|---|---|---|---|
| 34699 | 10/1965 | Finland | 294/118 |
| 574015 | 7/1924 | France | 294/118 |
| 976947 | 3/1951 | France | 294/118 |
| 61-130188 | 8/1986 | Japan . | |
| 29906 | of 1914 | United Kingdom | 294/118 |
| 620617 | 3/1949 | United Kingdom | 294/116 |

*Primary Examiner*—Johnny D. Cherry
*Attorney, Agent, or Firm*—Finnegan, Henderson, Farabow, Garrett & Dunner

[57] ABSTRACT

Disclosed is an auxiliary conveyance apparatus for conveying a body to be conveyed very easily in case of emergency including intermediate parts of a pair of arm members, each having a gripping portion and an operating lever on both the ends, respectively, being turnably pivoted, and the arm members being urged by elastic member so that the gripping portions are brought close to each other. An operating member is slidably attached to the operating levers, and the pair of the operating levers are opened and closed according to the distance from the gripping portions, and cooperatively with this closing and opening of the operating levers, the gripping force in the gripping portions is controlled. The operating member is anchored to a tractor through an anchoring device, and the position of the operating member relative to the operating levers is determined according to the balance between the tractive force acting on the operating member and the weight of the body to be conveyed and the gripping force in the gripping portions is controlled. An extension is provided on one operating arm member whereby a hand-applied force moving the extension toward the other arm member will oppose the urging force of the elastic member and allow selective engagement to the movable body.

3 Claims, 8 Drawing Sheets

APPARATUS FOR EMERGENCY CONVEYANCE OF A HUMAN BEING DISPOSED ON A MOVABLE BODY

BACKGROUND OF THE INVENTION (1) Field of the Invention

The present invention relates to apparatus for the conveyance of a movable body conveyance, which is used on drawing or conveying the body for holding the body assuredly and anchoring the body on a tractive member to transmit a tractive force of the tractive member to the body. More particularly, the present invention relates to an auxiliary apparatus for the emergency conveyance of a human being disposed on a movable body, which is especially suitably used for the emergency escape of a bedridden sick person or old man in case of emergency, for example, at the time of fire, by pulling the sick person or old man together with a bed sheet or carpet or by using the bed sheet or carpet as a stretcher.

(2) Description of the Related Art

In an asylum where persons who can hardly walk by themselves are received, for example, a hospital or a home for the aged, for the emergency escape of a sick person or old man at the time of a fire or the like, the sick person or old man is generally conveyed by using a stretcher or wheelchair or on the shoulder of a nurse.

However, in the above-mentioned facilities, in general, the number of equipped stretchers or wheelchairs is smaller than the number of inmates. Furthermore, escape on the shoulder of a nurse is not practical unless the number of inmates is small or the escape distance is short. Moreover, it is almost impossible to save an inmate by gripping the end of bedding and pulling it backward.

We previously proposed an auxiliary tool for suspending a cushion in the gripped state in Japanese Unexamined Utility Model Publication No. 61-130188. However, the object of this device is to suspend a cushion and expose it to sunlight, and this is not useful for the above-mentioned emergency escape. Namely, it is impossible to convey a sick person instead of the cushion by using this auxiliary tool.

SUMMARY OF THE INVENTION

It is a primary object of the present invention to provide an auxiliary apparatus for the emergency conveyance of a human being which can save a person, who can hardly walk by himself, safely and simply in case of emergency by placing the person on surrounding bedding such as a bed sheet, a carpet or a bathrobe and conveying the person together with the bedding.

Another object of the present invention is to provide an auxiliary apparatus for the emergency conveyance, which can convey a person relatively easily even in a narrow escape way without using a large conveyance apparatus such as a stretcher or a wheelchair.

In accordance with the present invention, these objects can be attained by an auxiliary apparatus for the emergency conveyance of a human being disposed on a movable body, which comprises a pair of curved arm members, intermediate parts in the length direction of said arm members being relatively turnably pivoted, an elastic member for elastically urging said arm members, an operating member for turning said arm members, and an anchoring device for anchoring the operating member to a tractive body, for example, another human being, wherein the arm members comprise a pair of gripping portions which are formed on one ends of the arm members to confront each other so that the body to be drawn is gripped between the gripping portions when the gripping portions approach to each other and a pair of operating lever portions having faces, the relative distance between them is changed according to the distance from the gripping portions, and the elastic member elastically urges the arm members in such a direction as bringing the pair of said gripping members close to each other and the operating member is hung over the pair of the operating lever portions so that the operating member can slide along the faces within a predetermined maximum distance in the length direction of the levers, whereby the pair of the gripping portions are brought close to each other as the distance from the gripping portions increases.

In the auxiliary apparatus of the present invention having the above-mentioned construction, if the gripping portions or operating portions are expanded by the hands and the end of bedding or the like is inserted between the gripping portions, the end of the bedding is compressed and gripped by the gripping portions which are urged by the elastic member, and if the operating member is drawn through the anchoring device in this state, the operating member is caused to slide on the faces in such a direction as separating the operating portions from the gripping portions and the relative distance between the operating portions is changed to bring the gripping portions close to each other, whereby emergency traction by a tractive body, especially a human being, can be easily accomplished.

In the present invention, it is preferred that in order to hold the bedding on which a sick person is placed, the pair of the arm members are curved between the pivoting portions and the gripping portions so that the arm members separate from each other.

More specifically, according to the present invention, the pair of the above-mentioned arm members cross each other at the pivoting portions and the pair of the operating lever portions have the above-mentioned faces which are directed outward so that the relative distance between the faces increases with increase of the distance from the gripping portions. There can be adopted a structure in which the operating member is a rigid body capable of sliding on each of said outward faces, which has at least one hole having a pair of inner faces spaced from each other by a predetermined distance, and the pair of the operating levers are fitted and inserted in this hole.

Various types can be considered as the rigid body. For example, there can be mentioned a plate-shaped member having two holes as mentioned above on both the sides of an intermediate part.

In the case where the tractive body is a human being, the anchoring device should comprise a length-adjustable belt. If this belt is hung on the shoulder of a carrier to receive the load on the shoulder, the emergency conveyance can be facilitated.

Each of the gripping portions comprises a gripping hand portion having a face recessed toward the body to be drawn and a claw formed on the end face on the side of the pivoting portion to project toward the other gripping portion. The bedding or the like can be gripped assuredly by these gripping hand portions. Each of these claws may have a toothed shape biting the claw of the other gripping hand portion or a toothed shape having projections confronting the projections of the claw of the other gripping hand portion.

If the gripping hand portions are swingably connected to the arm members, the gripping hand portions can follow the shape of the outer face of the body to be gripped, and therefore, the gripping force of the gripping hand portions can be effectively exerted on the body to be conveyed.

Each of the gripping portions may comprise a plate member having at least one top-sharpened pin projecting toward the body to be drawn.

At least one of the arm members can comprise an expanding extension formed by extending the outer end of the operating lever portion, and this extension can be formed to have such a shape that this extension and the arm member at a part on the side of the holding portion from the pivoting portion can be gripped by one hand. If this structure is adopted, the holding portions can be expanded by operating this extension by one hand and the bedding or the like can be inserted between the gripping portions by one hand, Accordingly, the auxiliary apparatus of the present invention can be set very simply by one person.

According to a preferred embodiment of the present invention, a pair of assemblies, each comprising a pair of the above-mentioned arm members, the above-mentioned elastic member and the above-mentioned operating member, are prepared, and the operating members of the assemblies are connected to each other by anchoring means such as a belt. According to this embodiment, in the state where the belt is hung on the shoulder of a carrier, pair of the auxiliary apparatuses can be simultaneously attached to the bedding or the like, and the bedding or the like can be hung down at two points by one person. Accordingly, the conveyance can be performed stably and the conveyance safety can be increased.

The present invention will become apparent from embodiments illustrated hereinafter, but the present invention is by no means limited by these embodiments and modifications made within the scope set forth in the claims are included in the present invention.

DETAILED DESCRIPTION OF THE PREFERRED EMBODIMENTS

Figure 1:
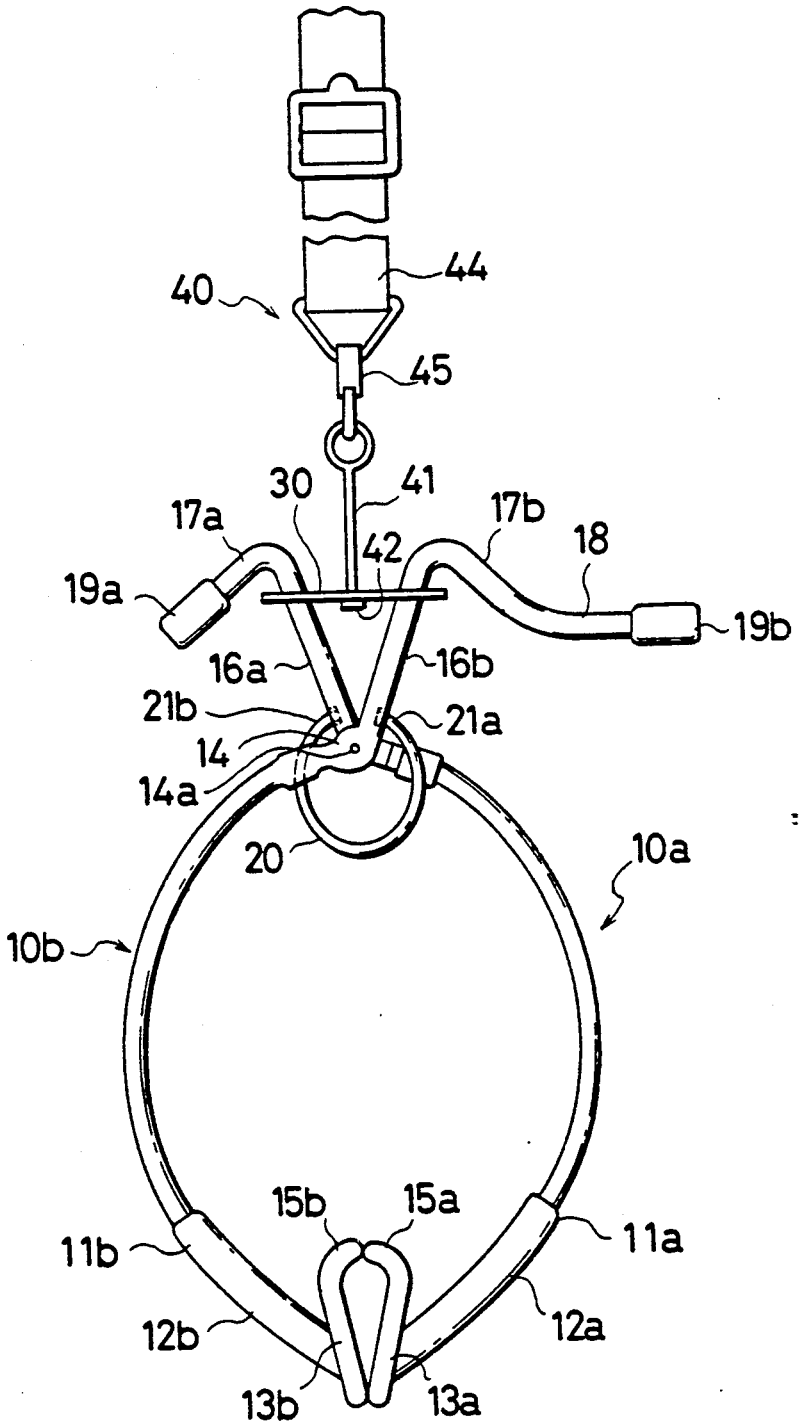
FIG. 1 is a front view of the auxiliary apparatus for the conveyance of a body particularly, the emergency conveyance of a human being disposed on a movable body, according to the present invention.
Figure 2:
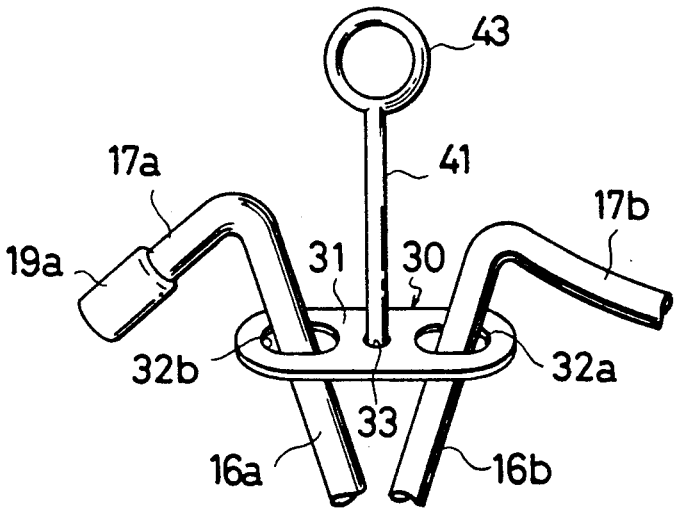
FIG. 2 is an enlarged perspective view of the operating portion of the apparatus shown in FIG. 1.

Referring to FIGS. 1 and 2, the auxiliary apparatus for the conveyance comprises, in principle, a pair of arm members 10*a* and 10*b*, an elastic spring 20, an operating member 30 for operating the arm members 10*a* and 10*b* and an anchoring device 40 for connecting the operating member 30 to tractive means.

The pair of the arm members 10*a* and 10*b* are composed mainly of a metal such as stainless steel or ordinary steel, and portions intermediate in the length direction of the arm members 10*a* and 10*b* cross each other and the arm members 10*a* and 10*b* are pivoted on a supporting shaft 14*a* such as a rivet at this crossing point. The arm members 10*a* 10*b* are curved to have an appropriate shape.

A pair of gripping portions 11*a* and 11*b* are formed on one side of this supporting portion 14 to confront one end of the arm members 10*a* and 10*b*, respectively. These gripping portions 11*a* and 11*b* are brought close to each other to grip therebetween an article on or in which a body to be conveyed is disposed, for example, bedding such as a bed sheet, carpet or bath robe on which a person who can hardly walk by himself is placed. The gripping portions 11*a* and 11*b* comprise pipe members 12*a* and 12*b* fixed to the top ends of the arm members 10*a* and 10*b* and gripping hand portions 13*a* and 13*b* having the top ends welded to the pipe members 12*a* and 12*b* and having the surfaces covered with a synthetic resin coating. The gripping hand portions 13*a* and 13*b* may be directly welded to the top ends of the arm members 10*a* and 10*b*. The gripping hand portions 13*a* and 13*b* can be contacted with each other gripping hand portion over an appropriate area and each gripping hand portion is formed to have a face recessed toward the other and has a claw 15*a* or 15*b* projecting toward the other gripping portion at the end close to the pivoting portion 14. The arm members 10*a* or 10*b* are curved so that they separate from each other between the pivoting portion 14 and the gripping hand portions 13*a* and 13*b*, and even if the body to be conveyed or drawn is between the arm members 10*a* and 10*b*, no interference is caused.

On the other side of the pivoting portion 14, operating levers 16*a* and 16*b* arranged as the other portions of the arm members 10*a* and 10*b*. The operating levers 16*a* and 16*b* are expanded in a V-shaped manner so that the distance between the operating levers 16*a* and 16*b* increases as they become distant from the pivoting portion 14.

Figure 3:
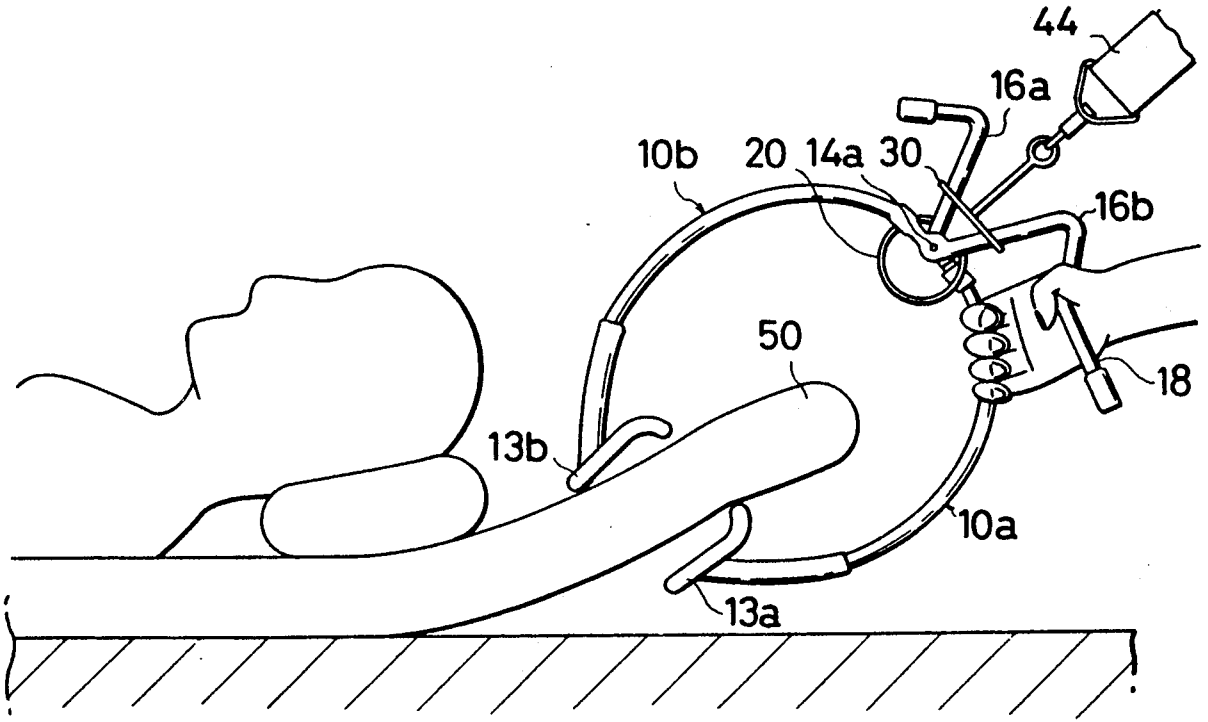
FIGS. 3 and 4 are front views showing the state of use of the auxiliary apparatus for the conveyance shown in FIG. 1.

The top ends of the operating levers 16*a* and 16*b* are bent outward to form stoppers 17*a* and 17*b*. At least one stopper 17*b* further extends substantially along the other arm member 10*a* on the side of the holding hand portion 13*a* to form an extension 18 for expanding the holding portions 11*a* and 11*b*. This extension 18 has a space sufficient to grip both this extension 18 and the other arm member 10*a* on the side of the gripping portion 11*a* from the pivoting portion 14 simultaneously by one hand of a carrier, and as shown in FIG. 3, if the gripping portion 11*a* is gripped so that the gripping portion 11*a* is brought close to the extension 18, both the arm members 10*a* and 10*b* are relatively turned around the supporting shaft 14*a*, whereby both the gripping hand portions 13*a* and 13*b* are expanded.

The top end portions of the stopper 17*a* and extension 18 are covered with protecting caps 19*a* and 19*b* composed of a synthetic resin or the like. Alternatively, these top end portions may be subjected to slip-preventing processing such as knurling or be wound with a tape. Moreover, instead of the method of attaching protecting caps, there can be adopted a method in which end edges of the stopper 17*a* and extension 18 are merely deformed by compression.

The gripping portions 11*a* and 11*b* are elastically urged by the elastic spring 20 in such a direction that they are brought close to each other. The elastic spring 20 is an annular elastic wire member having a joint opening and is arranged around the supporting shaft 14*a* in the expanded state. Confronting ends 21*a* and 21*b* in the joint opening portion are elastically fitted and anchored in holes formed on the outer faces of the operating lever portions 16*a* and 16*b*. Interference with the elastic spring 20 is avoided by pressing flat the arm members 10*a* and 10*b* at parts crossing the elastic spring 20. Alternatively, the elastic spring 20 may be a tensile coil spring (not shown) having both the ends secured to the confronting arm members and elastically urging the gripping hand portions 13*a* and 13*b* to bring them close to each other.

An operating member 30 is disposed between the operating levers 16*a* and 16*b*, and as shown in FIG. 2, the operating member 30 is a plate-shaped rigid body and the operating levers 16*a* and 16*b* are slidably inserted into long holes 32*a* and 32*b* formed on both the sides of an intermediate plate portion 31, so that when the operating member 30 is located on the open ends sides of the operating levers 16*a* and 16*b*, the operating levers 16*a* and 16*b* are attracted to each other by the inner faces on the outer sides of the long holes 32*a* and 32*b*. More specifically, the inner faces on the outer sides of the long holes 32*a* and 32*b* separated from each other by a predetermined distance slide on the outward faces of the operating levers 16*a* and 16*b*, but the operating levers 16*a* and 16*b* have such shapes that as the distance from the gripping hand portions 13*a* and 13*b* in the length direction of the operation levers increases, the relative distance between the operating levers 16*a* and 16*b* increases. Accordingly, as the distance between the operating levers 16*a* and 16*b* and the gripping hand portions 13*a* and 13*b* increases, the operating levers 16*a* and 16*b* are brought closer to each other. As the result, the arm members 10*a* and 10*b* pivot on the supporting shaft 14*a* and the gripping hand portions 13*a* and 13*b* are brought close to each other. Incidentally, since it is sufficient if the pair of the long holes 32*a* and 32*b* of the operating member 30 have a pair of inner faces on the outer side, in principle, one long holes suffices. The stoppers 17*a* and 17*b* formed on the operating levers 16*a* and 16*b* prevent the operating member 30 from falling down from the operating levers 16*a* and 16*b* when the operating member 30 abuts against the stoppers 17*a* and 17*b*.

An anchoring device 40 anchored on tractive means, such as a nurse or other human being effecting emergency conveyance, is connected to the operating member 30, and when the tractive means draws the operating member 30 through the anchoring device 40 in such a direction as separating the operating member 30 from the pivoting portion 14, the force of bringing the gripping hand portions 13*a* and 13*b* close to each other, that is, the gripping force, is increased. The anchoring device 40 comprises a tractive rod 41 slidably inserted in a through hole 33 formed in the intermediate plate portion 31 of the operating member 30. The tractive rod 41 is prevented from falling out from the through hole 33 by a stopper 42 formed on the top end thereof, and a hook 45 attached tot he end of a length-adjustable a tractive belt 44 is secured to a ring 43 arranged on the other end of the tractive rod 41. The tractive belt 44 is an annular flat belt which is wound around a tractor, that is, a carrier, and another hook attached to the other end of the tractive belt 44 is secured to the tractive rod 41 connected to the operating member 30 of another conveyance unit comprising the assembly shown in FIG. 1 and the tractive belt 44 is wound the shoulder of the carrier or otherwise anchored.

For example, in the case where a bedridden person is carried away in case of emergency by using the auxiliary apparatus for the conveyance, which has the above-mentioned construction, the anchoring device for the tractive belt 44 or the like is adjusted to a length suitable for a tractor or carrier. If a pair of the auxiliary apparatuses for the conveyance shown in FIG. 1 are connected to both the ends of the tractive belt 44, respectively, in each apparatus, the operating member 30 is moved in the direction of the pivoting portion 14 to set the operating levers 16*a* and 16*b* free, the extension 18 and the other arm member 10*a* are simultaneously gripped by one hand as shown in FIG. 3, and they are brought close to each other against the spring pressure of the elastic spring 20, whereby the gripping portions 11*a* and 11*b* are mutually expanded and the end of bedding 50 such as a sheet on which the bedridden persons lies is inserted and held between the gripping hand portions 13*a* and 13*b* by the other hand. If the hand is detached from the extension 18 in this state, the arm members 10*a* and 10*b* are turned with the supporting shaft 14*a* being as the center by the spring force of the elastic spring 20 (not shown in FIG. 3 for clarity), and the gripping hand portions 13*a* and 13*b* grip the bedding 50 assuredly. In order to attain an easy grip, it is preferred that the extension 18 be slightly convexly curved substantially along the arm member 10*a*. At this stage, the bedding 50 is supported only by the spring force of the elastic spring 20. The foregoing operations are carried out on each of the pair of the auxiliary apparatuses for the conveyance. It is preferred that both the corner portions of the bedding 50 be gripped by the pair of the auxiliary apparatuses for the conveyance, respectively.

Figure 4:
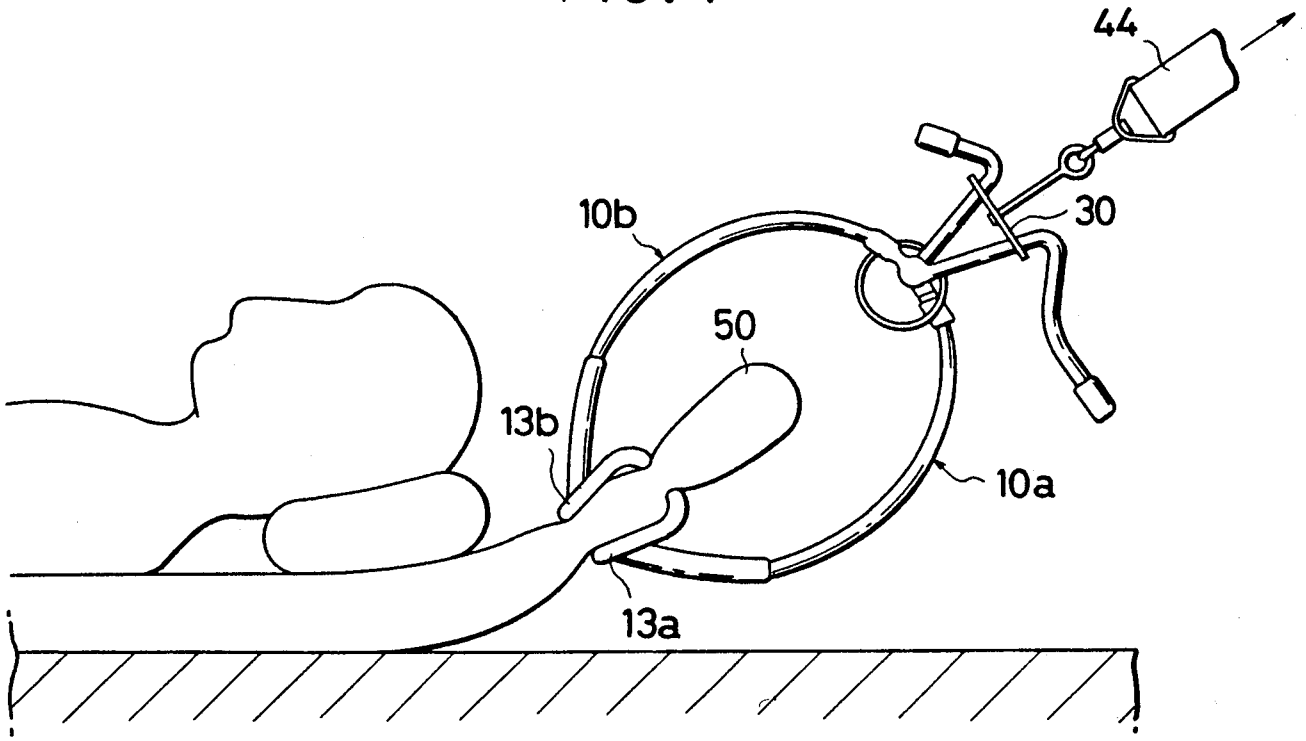
Figure 10:
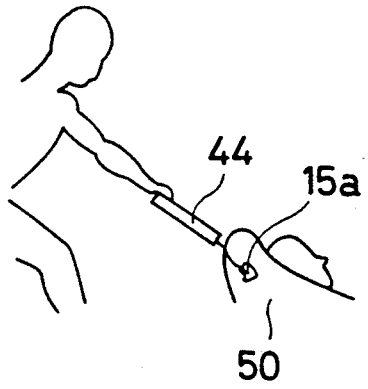
FIGS. 10 through 12 are diagrams illustrating embodiments of use of the auxiliary apparatus for the conveyance according to the present invention.
Figure 11:
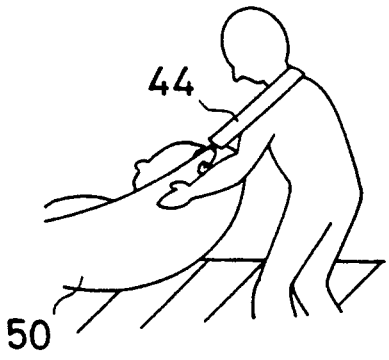
Figure 12:
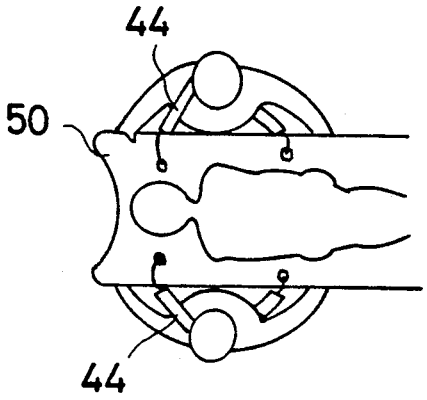

The tractive belt 44 of the thus attached auxiliary apparatus for the conveyance is held by a hand as shown in FIG. 10 or hung on the shoulder as shown in FIGS. 11 and 12, and when the tractive belt 44 is then pulled, as shown in FIG. 4, the operating member 30 is attracted toward the sides of the stoppers 17*a* and 17*b* of the operating levers 16*a* and 16*b* and the inner faces on the outer sides of the long holes 32*a* and 32*b* slide on the outward faces of the operating levers 16*a* and 16*b* to bring the operating levers 16*a* and 16*b* close to each other. If the tractive force is increased, by the weights of the bedding 50 and the person lying thereon and the frictional resistance between the bedding 50 and the floor, the operating member 30 is caused to slide further apart from the supporting shaft 14*a* and bring the operating levers 16*a* and 16*b* closer to each other. Co-operatively, the gripping hand portions 13*a* and 13*b* exert a gripping force increased in proportion to the produced load, and the gripping hand portions 13*a* and 13*b* grip the body to be drawn more strongly. At this point, both the hands of the carrier are free, and therefore, other parts of the bedding can be gripped by the hands or the carrier can take care of the person lying on the bedding.

In the case where one auxiliary apparatus for the conveyance is used, the annular tractive belt is held by the hand of the carrier or hung on the shoulder of the carrier, and the bedding is conveyed in the state where the bedding is gripped at one point.

As is apparent from the foregoing description, if the auxiliary apparatus for the conveyance according to the present invention is used, even without conveying means such as a stretcher or wheelchair, a person lying on a sheet or carpet or wrapped therewith can be drawn very simply and effectively, and in case of emergency, for example, at an outbreak of fire, a person who can hardly walk by himself can be promptly saved. Moreover, a shock imposed on a lying person can be weakened by a buffer action of a carpet or the like, and if the carpet is hung down, the carpet is wound to wrap the person and therefore, the person can be protected from sparks of fire. Accordingly, the apparatus of the present invention can be used very simply, and the tractive operation can be performed by one person and the safety is very high.

Moreover, since the manufacturing cost of the apparatus of the present invention is very small, escape tools in a number corresponding to the number of inmates can be equipped at much lower expenses than in case of stretchers and the like. Therefore, the apparatus of the present invention is suitable as a cost effective escape tool.

The present invention is not limited to the above-mentioned embodiments, but various modifications can be made. For example, the shapes and attachment positions of the arm members 10*a* and 10*b*, gripping hand portions 13*a* and 13*b*, operating levers 16*a* and 16*b*, extension 18, elastic spring 20, operating member 30, tractive rod 41 and tractive belt 44 can be optionally changed.

Figure 5:
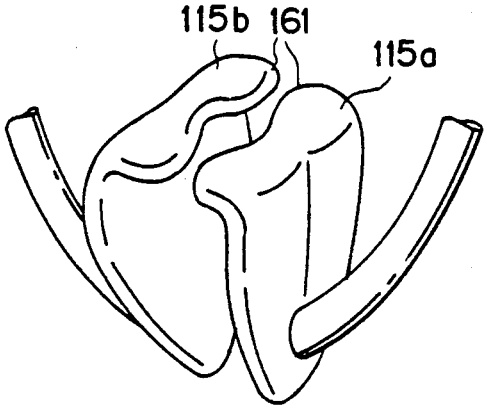
FIGS. 5 through 8 are perspective views showing other embodiments of the gripping portion.
Figure 6:
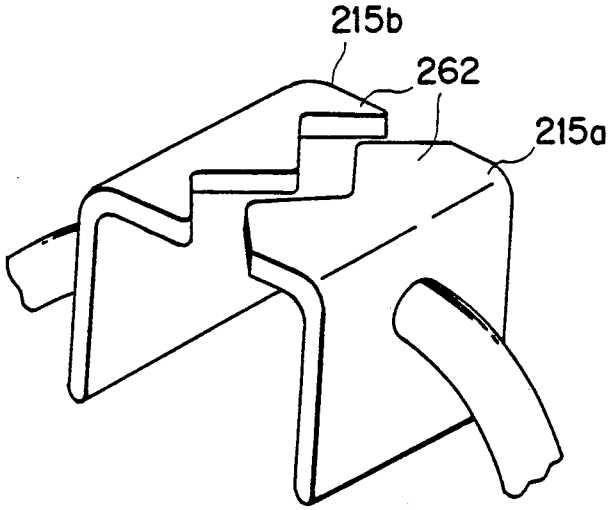
Figure 7:
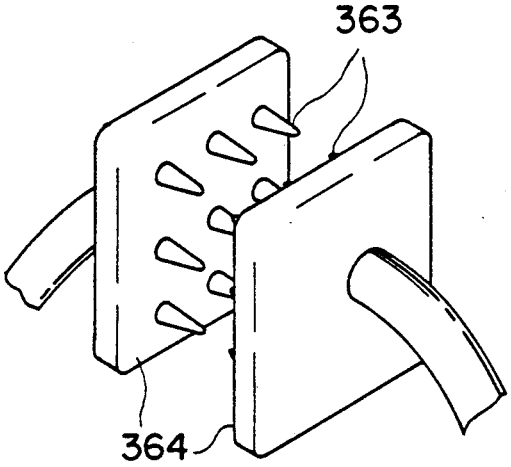
Figure 8:
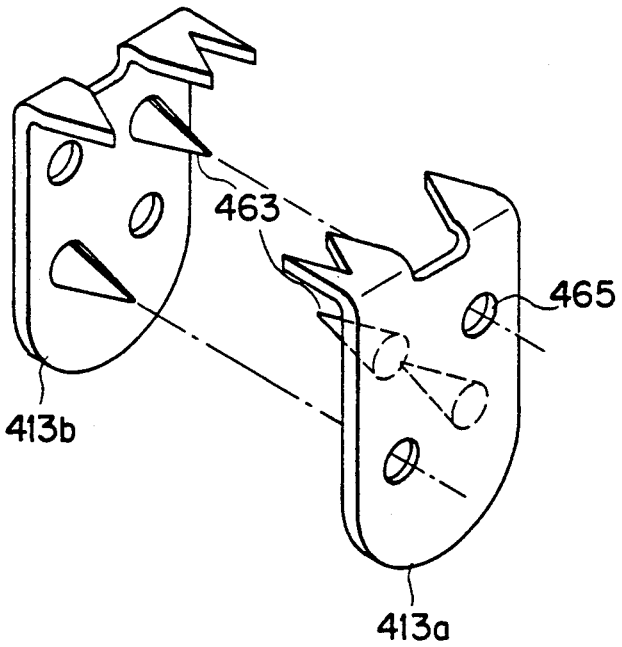
Figure 9:
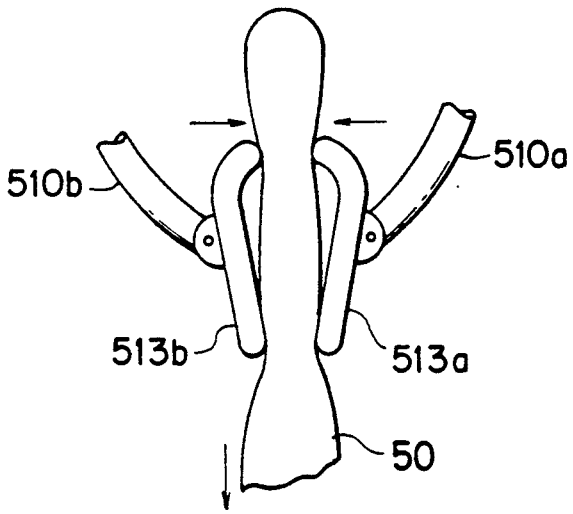
FIG. 9 is a side view illustrating still another embodiment of the gripping portion.

Various types of the gripping hand portions differing in the shape are effective. For example, a toothed shape having claws 115*a* and 115*b* having confronting projections 161 as shown in FIG. 5 or a shape having claws 215*a* and 215*b* having toothed portions 262 engaged with each other as shown in FIG. 6 can be adopted. The gripping hand portions 313*a* and 312*b* can be constructed by flat plates 364, each having at least one top-sharpened pin 363 projecting toward the other gripping hand portion, as shown in FIG. 7. In a variation of the embodiment of FIG. 7, a recess corresponding to the pin 463 of the other gripping hand portion, for example a hole 465, can be formed, as shown in FIG. 8. By thus increasing the gripping force of the gripping hand portions 413*a* and 413*b* or the biting force into the body to be conveyed, the conveyance characteristics in case of emergency can be improved. Furthermore, the gripping hand portions 513*a* and 513*b* can be swingably connected to the end portions of the arm members 510*a* and 510*b*, as shown in FIG. 9, and in this case, the pressing contact with the surface of the body to be conveyed can be accomplished uniformly and assuredly. As is apparent from the foregoing description, an optional shape can be adopted for the gripping hand portions in correspondence to the body to be conveyed, so far as the body can be gripped and conveyed.

With reference again to FIG. 1, the operating levers 16*a* and 16*b* may be formed integrally with the gripping portions 11*a* and 11*b*, or they can be constructed so that they can be separated from the gripping portions 11*a* and 11*b*. the extension 18 can be formed on each of both the operating levers 16*a* 16*b*. It is sufficient if the elastic spring 20 is capable of pressing and urging the gripping portions 11*a* and 11*b* to the body to be conveyed. For example, there alternately can be used a torsion spring arranged on the pivoting portion and having both the ends fixed to the arm members 10*a* and 10*b*, respectively. The elastic load of the elastic spring 20 can be freely set according to the object to be conveyed.

When the operating member 30 is pulled in a direction away from the gripping portions 11*a* 11*b* by the tractor, the operating member 30 exerts a force of bringing the gripping portions 11*a* and 11*b* close to each other. Accordingly, the operating member 30 can be constructed so that the operating levers have such inner faces that the distance between them decreases as the distance from the supporting shaft 14*a* becomes large, and the operating member slides on these inner faces to expand the distance between these inner faces, that is, the distance between the operating levers, as the distance from the supporting shaft 14*a* increases. It is not absolutely necessary that the arm members 10*a* and 10*b* should be arranged to cross each other at the pivoting portion 14 as in the above-mentioned embodiment, but there may be adopted a modification in which the arm is formed to have a bell crank shape and the bent portion is turnably pivoted.

As the tool for conveying the body to be conveyed, there is preferably used a tool having strength and size sufficient to convey a person in the state where the person is lying thereon or is wrapped therewith, for example, a mattress, a sheet or a bathrobe. In view of the strength, it is preferred that the arm members 10*a* and 10*b* be formed of a metallic material such as stainless steel, but they can be formed of a plastic material. Alternatively, the arm members 10*a* and 10*b* can be formed partially of a plastic material.

I claim:

1. Apparatus for engagement with and conveyance of a movable body by tractive means, the apparatus comprising at least one unit having:

a pair of elongated arms having respective proximal parts and distal parts relative to the location of the tractive means;

pivotal connection means interconnecting said pair of arms between said respective proximal and distal parts, said arms including respective confronting gripping end portions on the distal parts thereof, and respective operating lever portions on the proximal parts thereof, said operating lever portions being spaced apart a distance increasing with the distance from said pivotal connection means;

elastic means for urging said confronting gripping end portions toward one another;

a slidable operating member engageably interconnecting said operating lever portions;

anchor means for connecting said operating member to the tractive means; and hand-actuated means for selectively counteracting said elastic means, and separating said gripping end portions, said hand-actuated means including at least the operating lever portion of one of said arms having an extension configured to extend proximate and spaced from the distal part of the other of said arms for providing engagement of both said extension and said distal part simultaneously by a single hand for all positions of said arms during operation of the apparatus.

2. The apparatus as in claim 1 wherein said extension is curved to provide a hand grip.

3. The apparatus as in claim 1 comprising at least two of said units, wherein said respective anchor means are comprised of a single, length-adjustable belt connected to the respective operating member at opposed belt ends thereof.

* * * * *